US008754725B2

(12) United States Patent
Barnett

(10) Patent No.: US 8,754,725 B2
(45) Date of Patent: Jun. 17, 2014

(54) INTEGRATED LOSSY LOW-PASS FILTER

(75) Inventor: Ron Jay Barnett, Santa Rosa, CA (US)

(73) Assignee: National Instruments Corporation, Austin, TX (US)

( * ) Notice: Subject to any disclaimer, the term of this patent is extended or adjusted under 35 U.S.C. 154(b) by 643 days.

(21) Appl. No.: 13/025,692

(22) Filed: Feb. 11, 2011

(65) Prior Publication Data

US 2012/0025932 A1 Feb. 2, 2012

Related U.S. Application Data

(60) Provisional application No. 61/369,534, filed on Jul. 30, 2010.

(51) Int. Cl.
*H01P 1/203* (2006.01)
*H01P 1/22* (2006.01)

(52) U.S. Cl.
CPC ..... *H01P 1/203* (2013.01); *H01P 1/227* (2013.01)
USPC ..... 333/204; 333/81 A

(58) Field of Classification Search
USPC ..... 333/202, 204, 205, 81 A, 81 R
See application file for complete search history.

(56) References Cited

U.S. PATENT DOCUMENTS 6,147,576 A * 11/2000 Arevalo ..... 333/204
2006/0028289 A1 * 2/2006 Blacka ..... 333/81 A

* cited by examiner

*Primary Examiner* — Benny Lee
*Assistant Examiner* — Gerald Stevens
(74) *Attorney, Agent, or Firm* — Meyertons Hood Kivlin Kowert & Goetzel, P.C.; Jeffrey C. Hood; Stephen A. Mason

(57) ABSTRACT

An apparatus for filtering a signal is disclosed. The apparatus includes a conductive line affixed to a surface of a substrate. For a signal received at an end of the conductive line, the apparatus is configured to filter at least a portion of the frequency components of the signal. First and second resistive films are adjacent to a respective side of the conductive line along a first side of each of the first and second resistive films, respectively. The first and second resistive films have a first resistivity. Third and fourth resistive films adjacent to a respective one of the first and second resistive films along a second side of each of the first and second resistive films. Each second side of the first and second resistive films extends beyond the third and fourth resistive films. The third and fourth resistive films have a second resistivity.

32 Claims, 14 Drawing Sheets

INTEGRATED LOSSY LOW-PASS FILTER

CLAIM OF PRIORITY

This application claims priority to provisional U.S. Patent Application No. 61/369,534 filed on Jul. 30, 2010, which is hereby incorporated by reference in its entirety and for all purposes.

FIELD OF THE INVENTION

The present invention relates to the field of measurement and data acquisition systems, and more particularly to a method and apparatus for providing an integrated lossy low-pass filter.

DESCRIPTION OF THE RELATED ART

Scientists and engineers often use measurement systems to perform a variety of functions, including measurement of physical phenomena or behavior of a unit under test (UUT), test and analysis of physical phenomena, process monitoring and control, control of mechanical or electrical machinery, data logging, laboratory research, and analytical chemistry, to name a few examples.

A typical measurement system comprises a computer system with a measurement device or measurement hardware. The measurement device may be a computer-based instrument, a data acquisition device or board, a programmable logic device (PLD), an actuator, or other type of device for acquiring or generating data. The measurement device may be a card or board plugged into one of the I/O slots of the computer system, or a card or board plugged into a chassis, or an external device. For example, in a common measurement system configuration, the measurement hardware is coupled to the computer system through a PCI bus, PXI (PCI extensions for Instrumentation) bus, a GPIB (General-Purpose Interface Bus), a VXI (VME extensions for Instrumentation) bus, a serial port, parallel port, or Ethernet port of the computer system. Optionally, the measurement system includes signal conditioning devices which receive field signals and condition the signals to be acquired.

Mixers are found in many signal conditioning devices which receive field signals and output a desired signal. It is often desirable to have a low-pass filter at the output port of such a mixer to pass the desired component of the field signal as an output signal while absorbing any undesired components such as a local oscillator signal of the mixer or a radio frequency component of the field signal.

SUMMARY OF THE INVENTION

An apparatus for filtering a signal is disclosed. The apparatus includes a tapered conductive line affixed to a surface of a substrate. For a signal received at an end of the tapered conductive line, the apparatus is configured to filter at least a portion of the frequency components of the signal. First and second resistive films are affixed to the surface of the substrate. Each of the first and second resistive films is adjacent to a respective side of the tapered conductive line along a first side of each of the first and second resistive films, respectively. The first and second resistive films have a first resistivity. Third and fourth resistive films are affixed to the surface of the substrate. Each of the third and fourth resistive films is adjacent to a respective one of the first and second resistive films along a second side of each of the first and second resistive films. Each second side of the first and second resistive films extends beyond the third and fourth resistive films along a long axis of the tapered conductive line. The third and fourth resistive films have a second resistivity.

BRIEF DESCRIPTION OF THE DRAWINGS

A better understanding of the present invention can be obtained when the following detailed description of the preferred embodiment is considered in conjunction with the following drawings, in which.

Figure 1:
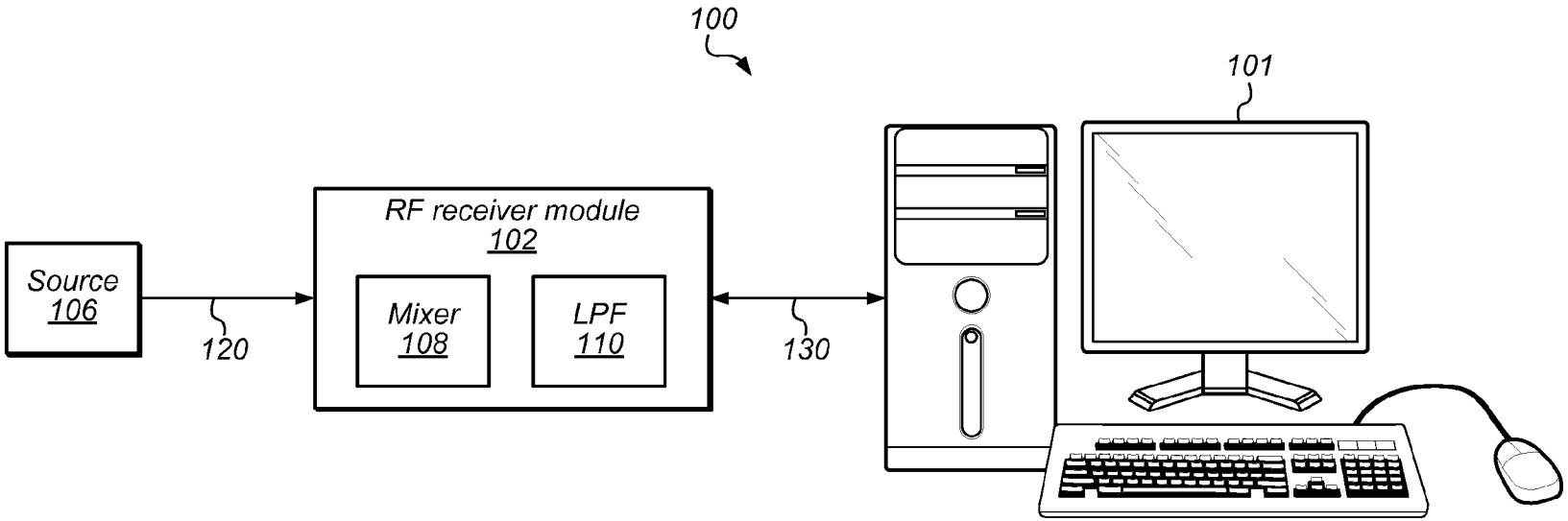
FIG. 1 illustrates a computer system configured to perform data acquisition functions compatible for use with an embodiment of the present invention.

While the invention is susceptible to various modifications and alternative forms, specific embodiments thereof are shown by way of example in the drawings and are herein described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

In one embodiment, an apparatus for filtering a signal includes a substrate and a tapered conductive line affixed to a surface of the substrate. A signal is received at one end of the tapered conductive line and transits the tapered conductive line to another end of the tapered conductive line for delivery of a selected component of the signal. The apparatus is configured to filter at least a portion of the frequency components of the signal. In one embodiment, a non-selected high-frequency component of the signal is diverted into a first resistive layer and a second resistive layer for absorption as the signal transits the tapered conductive line.

First and second resistive films are affixed to the surface of the substrate to form the first resistive layer. Each of the first and second resistive films is adjacent to a respective side of the tapered conductive line along a first side of each of the first and second resistive films, respectively. The first and second resistive films have a first resistivity. Third and fourth resistive films are affixed to the surface of the substrate to form a second resistive layer. Each of the third and fourth resistive films is adjacent to a respective one of the first and second resistive films along a second side of each of the first and second resistive films. Each second side of the first and second resistive films extends beyond the third and fourth resistive films along a long axis of the tapered conductive line. The third and fourth resistive films have a second resistivity.

FIG. 1: Data Acquisition System

FIG. 1 is a diagram of one embodiment of a computer-based measurement system or data acquisition system 100. The data acquisition system 100 may comprise a computer system 101, which may be coupled to a measurement device, such as a radio receiver, referred to as RF receiver module 102, through a communication medium 130. RF receiver module 102 may be an internal card or board coupled to a bus, e.g., a Peripheral Component Interconnect (PCI), PCI Express, Industry Standard Architecture (USA), or Extended Industry Standard Architecture (EISA) bus, but is shown external to the computer 101 for illustrative purposes. RF receiver module 102 may also be an external device coupled to the computer system 101. In this embodiment, the communication medium 130 may be a serial bus, such as USB, IEEE 1394, MXI bus, Ethernet, or a proprietary bus, or a parallel bus such as GPIB or others. It is noted that the communication medium 130 may be a wired or wireless communication medium.

RF receiver module 102 may be coupled to an external source 106, such as an instrument, antenna, sensor, transducer, or actuator from which RF receiver module 102 may receive an input signal 120, e.g., an analog input such as sensor data. In one example, the external source 106 may be a radio frequency sensor, which is comprised in a unit under test (UUT). In this example, RF receiver module 102 may receive radio frequency signal readings from the radio frequency sensor and convert the analog data to digital form to be sent to the computer system 101 for analysis. Additionally, RF receiver module 102 may receive a digital input, e.g., a binary pattern, from the external source 106 (e.g., a UUT). Furthermore, the RF receiver module 102 may also produce analog or digital signals, e.g., for stimulating the UUT.

The data acquisition device contains a mixer 108 and a low-pass filter 110 for processing analog signals received from source 106 before the signals are converted to digital signals and provided over communication medium 130 to computer system 101. In some embodiments, low-pass filter 110 will be integrated as a component of mixer 108. In one embodiment, mixer 108 is a down-converting mixer and low-pass filter 110 is attached at an intermediate frequency (IF) port of mixer 108. Mixer 108 is, in such an embodiment, a wide-band high-frequency (3.6-15 GHz) down-converting mixer. Such a mixer is typically a 3-port device in which two input signals, a local oscillator (LO) and a radio frequency input (RF) are mixed to produce an IF signal output that is a mixing product of the RF and LO signals. The IF signal contains both the sum and difference of the two input frequencies, RF and LO, such that, in terms of frequency, IF=LO±RF. More generally, the frequency F of all mixing products at the IF port of a mixer is given by the following expression: $F=m\times LO\pm n\times RF$, where RF is the frequency of the small signal input to the mixer, LO is the frequency of the local oscillator, and m and n are integers.

In many applications, the lower frequency component is the desired signal and can be obtained by low-pass filtering the mixer output signal. For such a mixer, one embodiment of low-pass filter 110 provides a near non-reflective termination for the local oscillator (LO) signal and accompanying products up to a third harmonic of the local oscillator signal (45 GHz). In the use of wideband down-converting mixers, it is often desirable to have a low-pass filter at the IF (intermediate frequency) port. In one embodiment, low-pass filter 110 is designed to pass a desired low frequency IF signal while rejecting through absorption high-frequency LO and RF signals and harmonics of the LO and RF, and all sums & differences of the LO and RF signals and their harmonics (M*LO+/−N*RF).

In particular, some embodiments are optimized to absorb frequencies at L+R at an IF port, which protects the mixer from reflection of the L+R signal at the IF port that would interfere with the use of the L−R product by remixing with the original L product recreating an R signal (L+R)−L=R at the R port of the mixer. This second R product changes in phase, compared to the R signal originally presented at the R port of the mixer causing a variation in amplitude of the desired IF signal at the IF port (commonly called "ripple"), as the mixer is tuned across the entire R band.

In many applications, the lower frequency component of signals emerging from any of the three ports (L, R, IF) other than the desired output frequency of the mixer can be absorbed by a lossy low pass filter as described herein. An example of an absorbable signal is the absorption of the 2L−R signal emerging from the R port. Such a 2L−R signal reflects off of a reflective RF input filter back into the mixer, recreating the original RF input signal with changes in phase as the mixer is tuned across the RF band. This newly created phase-changing RF input signal adds in-phase and out-of-phase signal components at the RF port, causing the net RF signal presented to the mixer to vary in amplitude as the mixer is tuned across the RF band. The net result of such a reflection is amplitude ripple at the output signal of the mixer as the RF signal is tuned across its band.

Some embodiments of the present invention are configured to provide a low-pass filter 110 that absorbs the LO signal and all of harmonics of the LO signal up to the third harmonic. Absorption of the LO signal and harmonics of the LO signal up to the third harmonic can help to eliminate signal components that often have sufficiently high amplitude that reflecting them back into the mixer would have detrimental effects on the performance of the mixer. Absorption of the LO signal and harmonics of the LO signal up to the third harmonic can improve the mixer's conversion loss, flatness and third order intercept (TOI). In some embodiments, absorption of the LO signal and harmonics of the LO signal up to the third harmonic can reduce spurious products and conversion loss (CL) ripple in the pass band of the output signal.

Absorption of the LO signal and harmonics of the LO signal up to the third harmonic can reduce or eliminate reflected signals that create products that take power from the desired signals as the mixer is tuned across its band. Therefore, at the IF port, some embodiments of low-pass filter 110 are configured to absorb all out-of-band products rather than reflecting them. For a mixer with an LO signal range extending to 16 GHz, the embodiments of the present invention can be configured to provide a return loss, e.g., greater than 10 dB, to 48 GHz. At these frequencies, low-pass filter 110 effectively passes IF frequencies while absorbing the higher-frequency components including the RF signal, LO signal and their harmonics, as well as other higher-order mixing products of those components by using shaped conductors in contact with resistive films arranged in layers of different resistivities.

Computer system 101 may be operable to control RF receiver module 102. For example, computer system 101 may be operable to direct RF receiver module 102 to perform an acquisition, and may obtain data from RF receiver module 102 for storage and analysis therein. Additionally, the computer system 101 may be operable to send data to RF receiver module 102 for various purposes, such as for use in generating analog signals used for stimulating a UUT.

The computer system 101 may include a processor, which may be any of various types, including an x86 processor, e.g., a Pentium™ class, a PowerPC™ processor, a CPU from the SPARC™ family of RISC processors, as well as others. Also, the computer system 101 may also include one or more memory subsystems (e.g., Dynamic Random Access Memory (DRAM) devices). The memory subsystems may collectively form the main memory of computer system 101 from which programs primarily execute. The main memory may be operable to store a user application and a driver software program. The user application may be executable by the processor to conduct the data acquisition/generation process. The driver software program may be executable by the processor to receive data acquisition/generation tasks from the user application and program RF receiver module 102 accordingly.

The computer system 101 may include at least one memory medium on which one or more computer programs or software components according to one embodiment of the present invention may be stored. For example, the memory medium may store one or more graphical programs which are executable to perform the methods described herein. Additionally, the memory medium may store a graphical programming development environment application used to create and/or execute such graphical programs. The memory medium may also store operating system software, as well as other software for operation of the computer system. Various embodiments further include receiving or storing instructions and/or data implemented in accordance with the foregoing description upon a carrier medium.

Exemplary Systems

Embodiments of the present invention may be involved with performing test and/or measurement functions and controlling and/or modeling instrumentation or industrial automation hardware. However, it is noted that embodiments of the present invention can be used for a plethora of applications and are not limited to the above applications. In other words, applications discussed in the present description are only examples, and embodiments of the present invention may be used in any of various types of systems. Thus, embodiments of the system and method of the present invention are configured to be used in any of various types of applications, including the operation and control of other types of devices such as multimedia devices, video devices, audio devices, telephony devices, Internet devices, radio frequency communication devices, etc.

Figure 2:
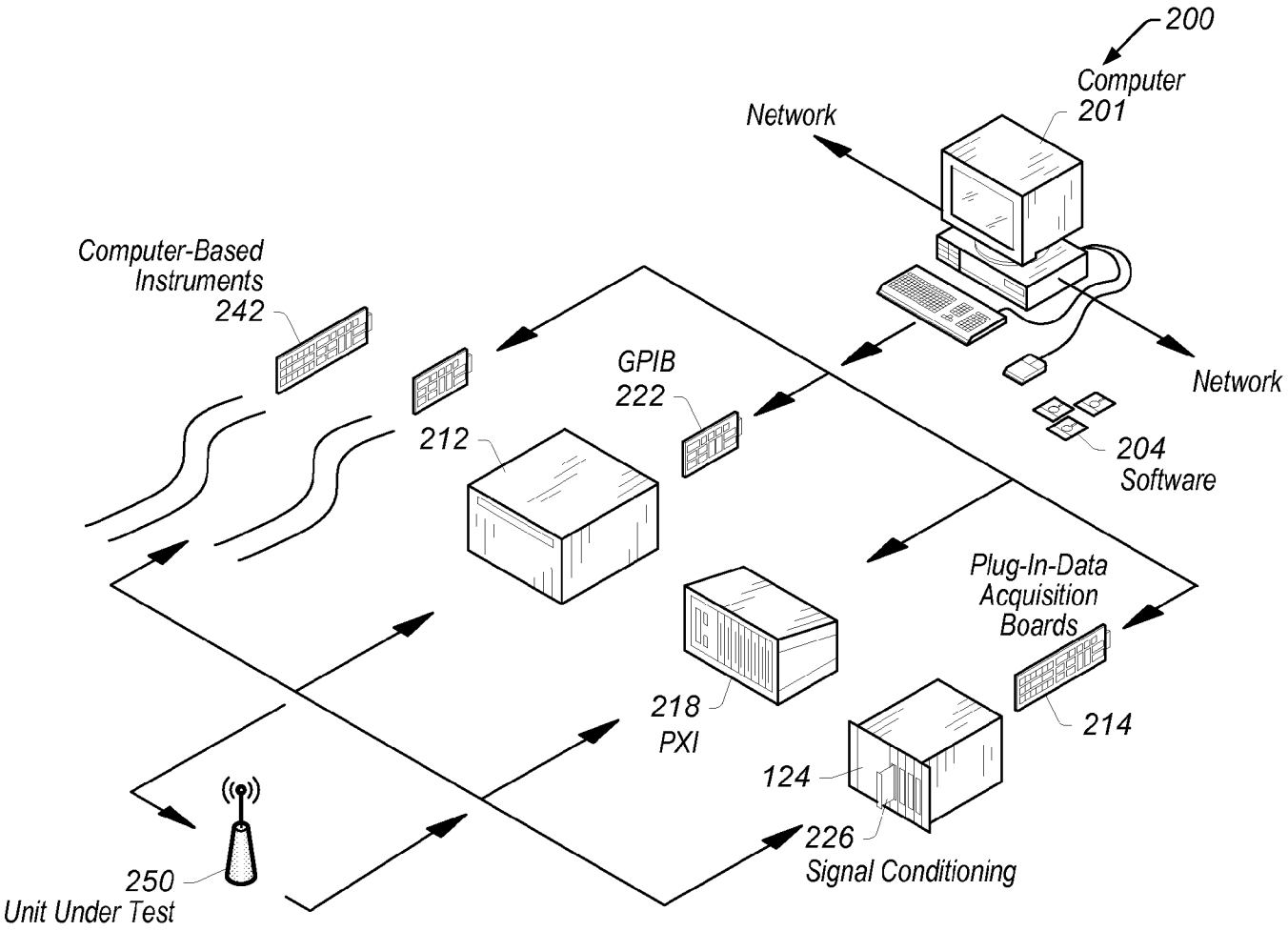
FIG. 2 illustrates an instrumentation control system compatible for use with one embodiment of the invention.

FIG. 2 illustrates an exemplary instrumentation control system 200 which may implement embodiments of the invention. The system 200 comprises a host computer 201 which couples to one or more instruments. The host computer 201 may comprise a CPU, a display screen, memory, and one or more input devices such as a mouse or keyboard as shown. The computer 201 may operate with the one or more instruments to analyze, measure or control a unit under test (UUT) 250 or other process (not shown).

The one or more instruments may include a GPIB instrument 212 and associated GPIB interface card 222, a data acquisition board 214 inserted into or otherwise coupled with chassis 224 with associated signal conditioning circuitry 226, a PXI instrument 218, and/or one or more computer based instrument cards 242, among other types of devices. The computer system may couple to and operate with one or more of these instruments. The instruments may be coupled to the unit under test (UUT) 250 or other process, or may be coupled to receive field signals, typically generated by transducers. Prior to transmission of data to computer 201, such field signals may be processed using an embodiment of the filter apparatus (not shown) described above. The system 200 may be used in a data acquisition and control application, in a test and measurement application, an image processing or machine vision application, a process control application, a man-machine interface application, a simulation application, or a hardware-in-the-loop validation application, among others.

Figure 3:
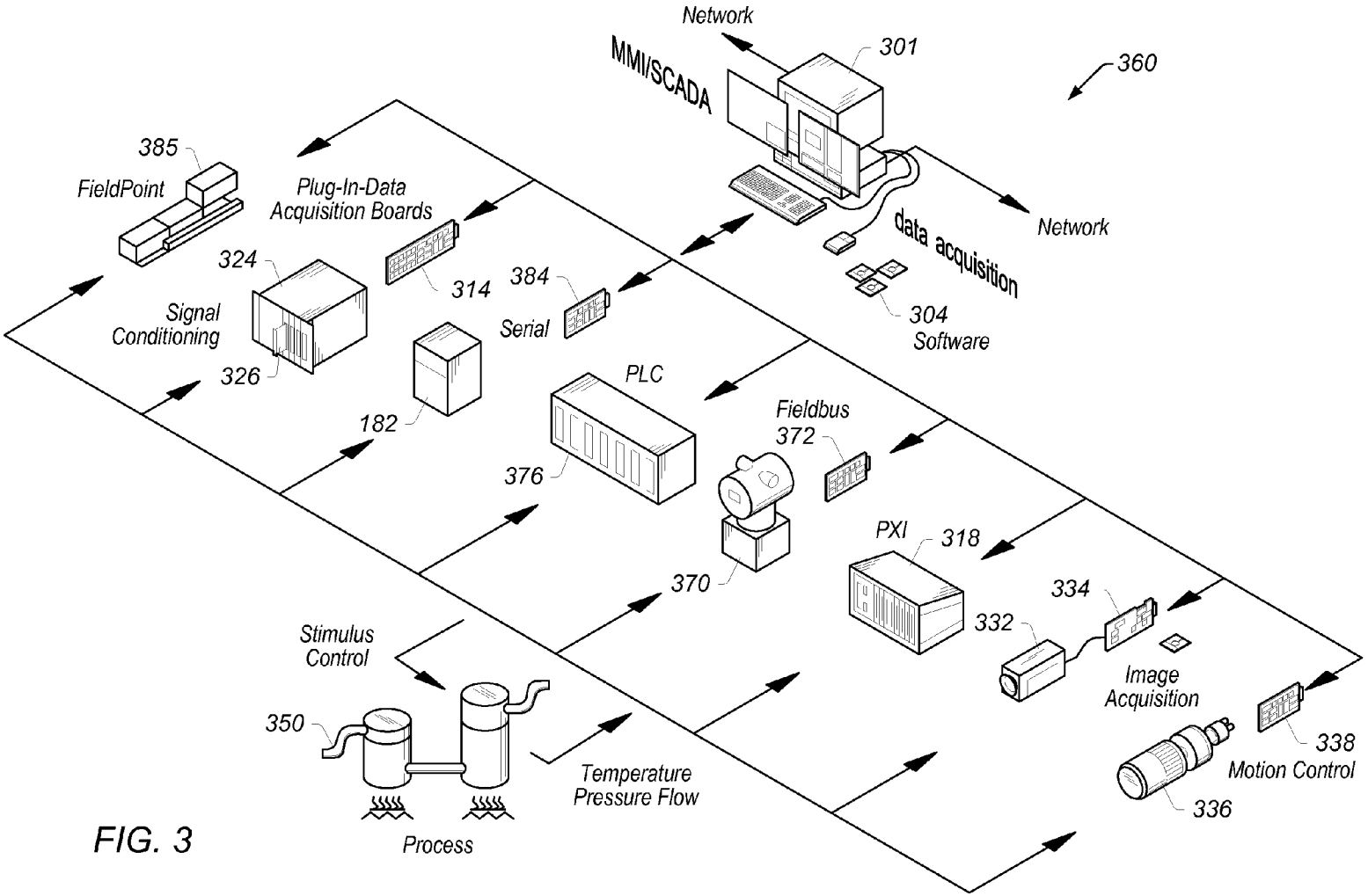
FIG. 3 illustrates an industrial automation system compatible for use with one embodiment of the invention.

FIG. 3 illustrates an exemplary industrial automation system 360 which may implement embodiments of the invention. The industrial automation system 360 is similar to the instrumentation or test and measurement system 200 shown in FIG. 2. The system 360 may comprise a computer 301 which couples to one or more devices or instruments. The computer 301 may comprise a CPU, a display screen, memory, and one or more input devices such as a mouse or keyboard as shown. The computer 301 may operate with the one or more devices to perform an automation function with respect to a process or device 350, such as MMI (Man Machine Interface), SCADA (Supervisory Control and Data Acquisition), portable or distributed data acquisition, process control, advanced analysis, or other control, among others.

The one or more devices may include a data acquisition board 314 inserted into or otherwise coupled with chassis 324 with associated signal conditioning circuitry 326, a PXI instrument 318, a video device 332 and associated image acquisition card 334, a motion control device 336 and associated motion control interface card 338, a fieldbus device 370 and associated fieldbus interface card 372, a PLC (Programmable Logic Controller) 376, a serial instrument 382 and associated serial interface card 384, or a distributed data acquisition system, such as the Fieldpoint system available from National Instruments, among other types of devices. The computer system may couple to and operate with one or more of these devices. The instruments may be coupled to the process or device 350, or may be coupled to receive field signals, typically generated by transducers. Prior to transmission of data to computer 301, such field signals may be processed using an embodiment of the filter apparatus (not shown) described above.

Figure 4:
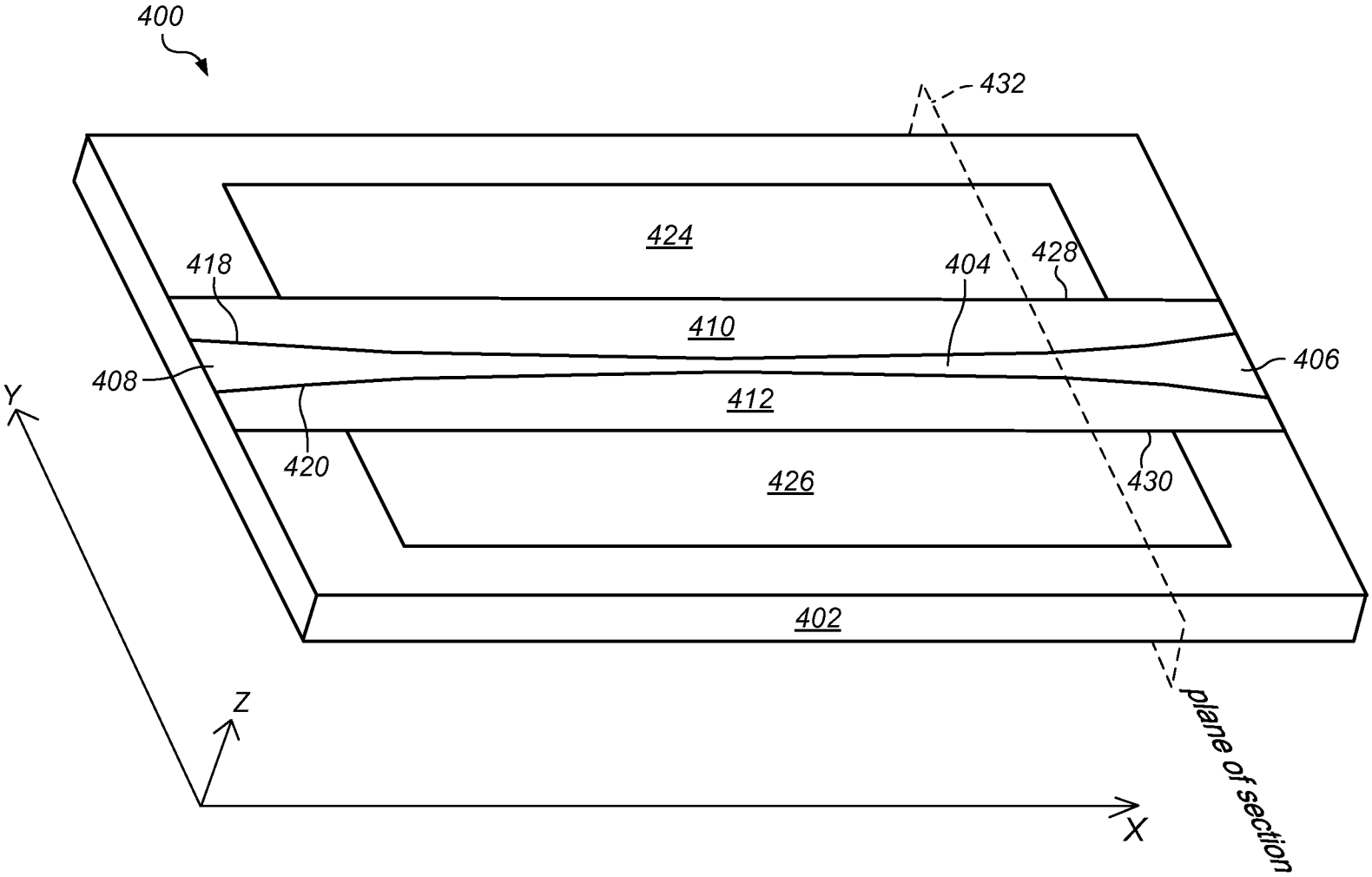
FIG. 4 is a three-dimensional layout diagram illustrating an integrated lossy low-pass filter according to one embodiment of the present invention.

FIG. 4 is a three-dimensional layout diagram illustrating components of an integrated lossy low-pass filter according to an embodiment of the present invention. An integrated device 400 is configured to filter at least a portion of the frequency components of the signal. Integrated device 400 includes a substrate 402. In one embodiment, substrate 402 is composed of Silicon or composed of Silicon and other elements. Alternatively, other material, for example, corundum (crystalline $Al_2O_3$ with other trace elements) or Gallium arsenide (GaAs) can be used to create substrate 402. A tapered conductive line 404 is affixed to a surface of substrate 402. Material composition of tapered conductive line 404 may vary between embodiments. Examples of material composition for tapered conductive line 404 include gold, silver, copper and alloys of one or more of gold, silver, or copper.

A first resistive film 410 and a second resistive film 412 have a first resistivity. First resistive film 410 and second resistive film 412 are affixed to the surface of substrate 402. Each of first resistive film 410 and second resistive film 412 is adjacent to a respective side of tapered conductive line 404 at a first boundary 418 along a first side of first resistive film 410 and a second boundary 420 along a first side of second resistive film 412, respectively.

A third resistive film 424 and a fourth resistive film 426 have a second resistivity. Values of first resistivity and second resistivity will vary between embodiments of the present invention. In one embodiment, the first resistivity is ½ of the value of the second resistivity. For example, tapered conductive line 404 may be fabricated from gold and bounded along both of its long sides by first resistive film 410 and second resistive film 412 of 50 ohms per square resistivity. Similarly, first resistive film 410 and second resistive film 412 may be bounded by third resistive film 424 and fourth resistive film 426 of 100 ohms per square resistivity in order to form a progressively more resistive absorptive layer. In this fashion, integrated device 400 functions in a manner analogous to a 2D anechoic chamber for those high-frequency signals in the stop-band and a near lossless transmission line in the low-frequency pass band.

Third resistive film 424 and fourth resistive film 426 are affixed to the surface of substrate 402. Each of third resistive film 424 and fourth resistive film 426 is adjacent to a respective second side of first resistive film 410 and second resistive film 412 at a third boundary 428 along a second side of first resistive film 410 and a fourth boundary 430 along a second side of second resistive film 412, respectively. Each second side of the first resistive film 410 and second resistive film 412 extends beyond third resistive film 424 and fourth resistive film 426 along a transmission axis of tapered conductive line 404. A plane of section 432 is indicated in FIG. 4 for reference with respect to a section drawing in FIG. 5.

In one embodiment, integrated device 400 provides an integrated lossy low-pass filter (LLPF). A signal is received from a set of multiple conductors at a first end 406 of tapered conductive line 404 and transmitted along tapered conductive line 404 to a second end 408 of tapered conductive line 404, which terminates in a single conductor. In one embodiment, a high-frequency component of the signal is diverted into and dissipated in first resistive film 410, second resistive film 412, third resistive film 424 and fourth resistive film 426 as the signal transits tapered conductive line 404. In some embodiments, integrated device 400 is a distributed device optimized with respect to out-of-band return loss and simultaneously maintains low in-band insertion loss (IL). In one embodiment, the composition and geometry of distributed elements, such as tapered conductive line 404, first resistive film 410, second resistive film 412, third resistive film 424 and fourth resistive film 426, extend a high-frequency end of a stop band while maintaining return loss out-of-band similar to that present in-band.

In one embodiment, integrated device 400 has a length less than or equal to 250 mils (milli-inches). In alternative embodiments, length is scaled up or down to trade off in-band insertion loss (IL) for match and stop-band attenuation. In an embodiment with length less than or equal to 250 mils (milli-inches), integrated device 400 is configured to exhibit low insertion loss for the 612.5 MHz IF signal and no upper frequency limit for the absorptive high-frequency stop band. Further, in one embodiment, the stop band becomes progressively more effective with increasing frequency.

Figure 5:
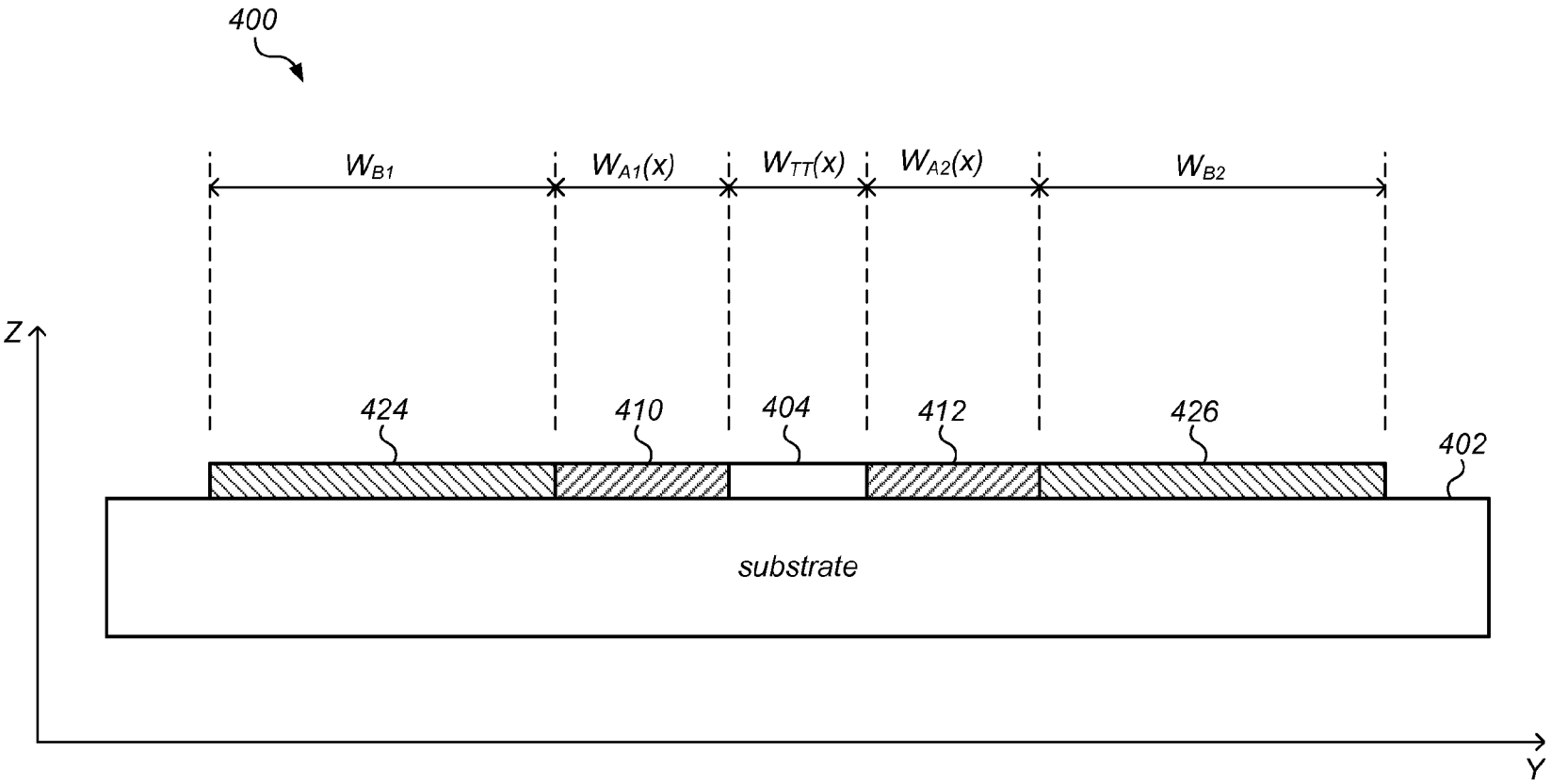
FIG. 5 is a section diagram illustrating one embodiment of an integrated lossy low-pass filter.

FIG. 5 is a section diagram illustrating one embodiment of an integrated lossy low-pass filter according to an embodiment of the present invention. With reference to FIG. 4, the section of FIG. 5 is taken along section line 432. Tapered conductive trace 404 runs perpendicular to section line 432 and has a variable width $W_{TT}(x)$, where x represents a longitudinal value along tapered conductive trace 404. In some embodiments, the widths $W_{B1}$ of third resistive film 424 and $W_{B2}$ of fourth resistive film 426 are equal and are constant throughout the length of third resistive film 424 and fourth resistive film 426. The variable width $W_{A1}(x)$ of first resistive film 410 and the variable width $W_{A2}(x)$ of second resistive film 412 are in, some embodiments, configured such that the sum $W_{A1}(x)+W_{TT}(x)+W_{A2}(x)$ is constant. In the embodiment portrayed in FIG. 5, tapered conductive line 404, first resistive film 410, second resistive film 412, third resistive film 424 and fourth resistive film 426 are shown as being of equal thickness (i.e., extent in the z direction). However, embodiments are contemplated where the thicknesses are different from one another and such embodiments do not depart from the scope and intent of the present invention.

One of skill in the art will further realize, in light of having read the present disclosure, that the number and relative arrangement of first resistive film 410, second resistive film 412, third resistive film 424 and fourth resistive film 426 will vary between embodiments without departing from the present disclosure. For example, in some embodiments, first resistive film 410 and second resistive film 412 will form or be formed from a single piece of material of consistent composition and tapered conductive line 404 will be deposited above or below (with respect to the z axis in FIG. 5) first resistive film 410, second resistive film 412 without departing from the scope of the present disclosure. Likewise, in some embodiments first resistive film 410 and second resistive film 412 may be arranged above or below (with respect to the z axis) third resistive film 424 and fourth resistive film 426, which may likewise form or be formed from a single piece of material of consistent composition. In some embodiments, tapered conductive line 404, first resistive film 410, second resistive film 412, third resistive film 424 and fourth resistive film 426 may be realized by a concentric radial arrangement of layers radially surrounding tapered conductive line 404 without departing from the scope and intent of the present disclosure.

Figure 6:
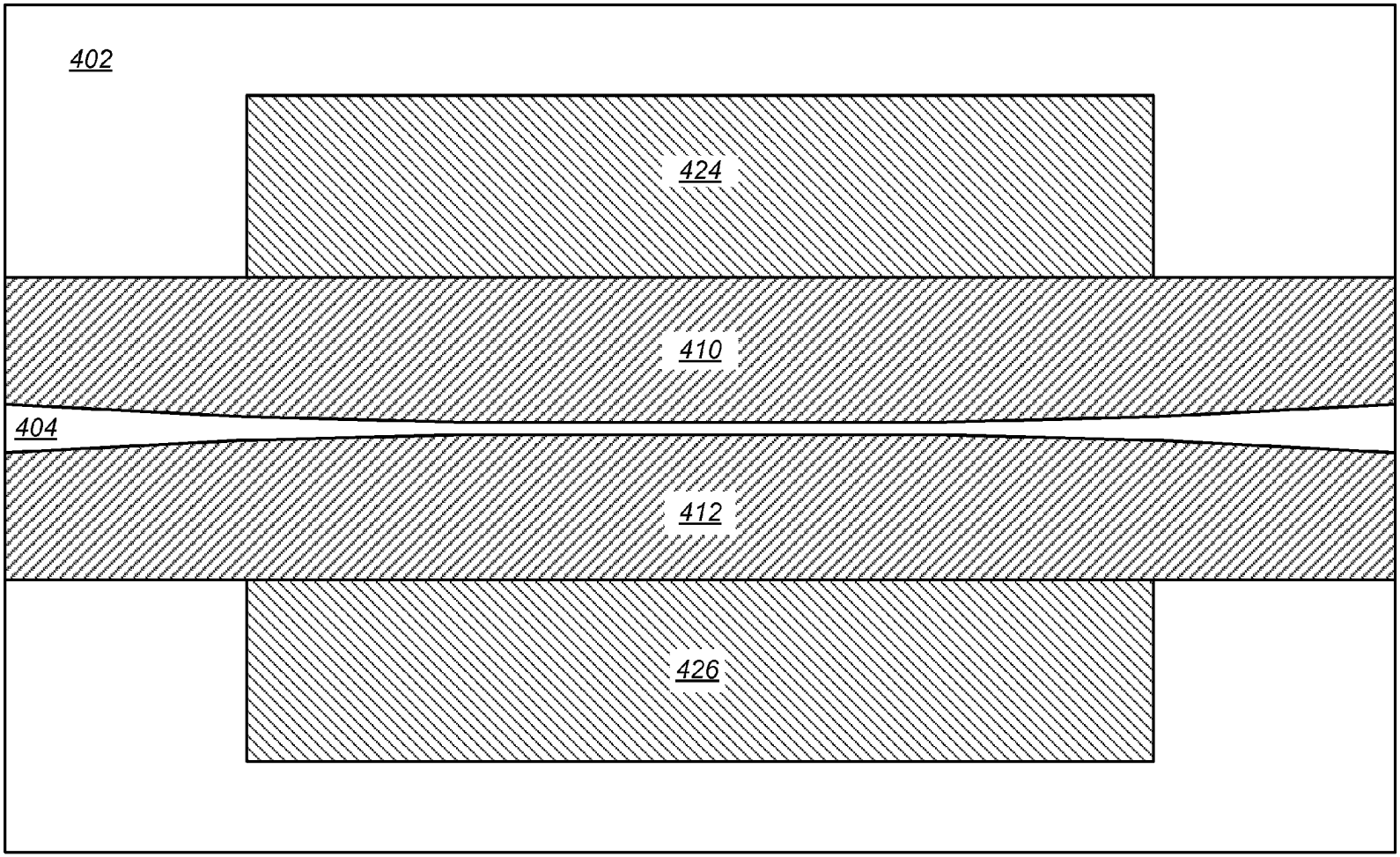
FIG. 6 is a two-dimensional layout diagram illustrating an integrated lossy low-pass filter according to an embodiment of the present invention.

FIG. 6 is a two-dimensional layout diagram illustrating one embodiment of an integrated lossy low-pass filter. Integrated device 400 includes a substrate 402, which, in one embodiment, is rectangular. A tapered conductive line 404 runs lengthwise across substrate 402. A first resistive film 410 and a second resistive film 412 have a first resistivity and run parallel to tapered conductive line 404 along an entire length of tapered conductive line 404. Each of first resistive film 410 and second resistive film 412 is adjacent to a respective side of tapered conductive line 404.

A third resistive film 424 and a fourth resistive film 426 have a second resistivity. Each of third resistive film 424 and fourth resistive film 426 is adjacent to a respective second side of first resistive film 410 and second resistive film 412. Each second side of the first resistive film 410 and second resistive film 412 extends beyond third resistive film 414 and fourth resistive film 416 along a long axis of tapered conductive line 404.

Figure 7:
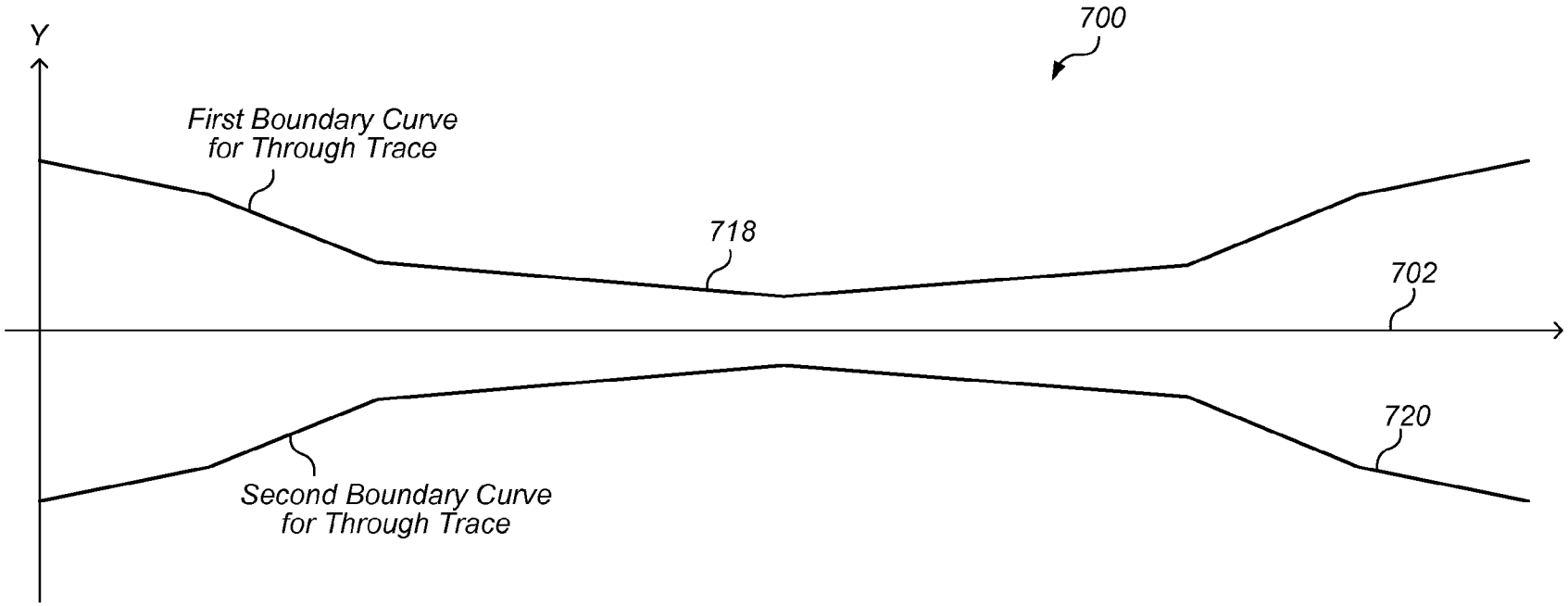
FIG. 7 illustrates an exemplary pair of boundary curves for defining an interface between a tapered conductive line and a pair of resistive films according to an embodiment of the present invention.

FIG. 7 illustrates an exemplary pair of boundary curves for defining an interface between a tapered conductive line and a pair of resistive films according to an embodiment of the present invention. In some embodiments, a boundary curve pair 700 is a mirror image with respect to a centerline 702 of a conductive through trace (such as tapered conductive line 404, not shown). However, embodiments are contemplated in which boundary curve pair 700 is not a mirror image with respect to a centerline 702. In the embodiment pictured in FIG. 7, each of first boundary curve 718 and second boundary curve 720 is piecewise linear. In alternative embodiments, however, first boundary curve 718 and second boundary curve 720 are piecewise polynomial, piecewise analytic functions, piecewise exponential (i.e., a composite of exponential functions that join together continuously or perhaps smoothly), etc., depending on the desired properties of the resulting filter.

Further, while the present disclosure discusses example embodiments in which a tapered conductive line is defined by each of first boundary curve 718 and second boundary curve 720, one of skill in the art will readily realize, in light of having read the present disclosure, that each of first boundary curve 718 and second boundary curve 720 may be defined by a straight line, by a continuous taper, by a stairstep taper, or by another function determining the shapes of each of first boundary curve 718 and second boundary curve 720 without departing from the scope and intent of the present disclosure.

Figure 8:
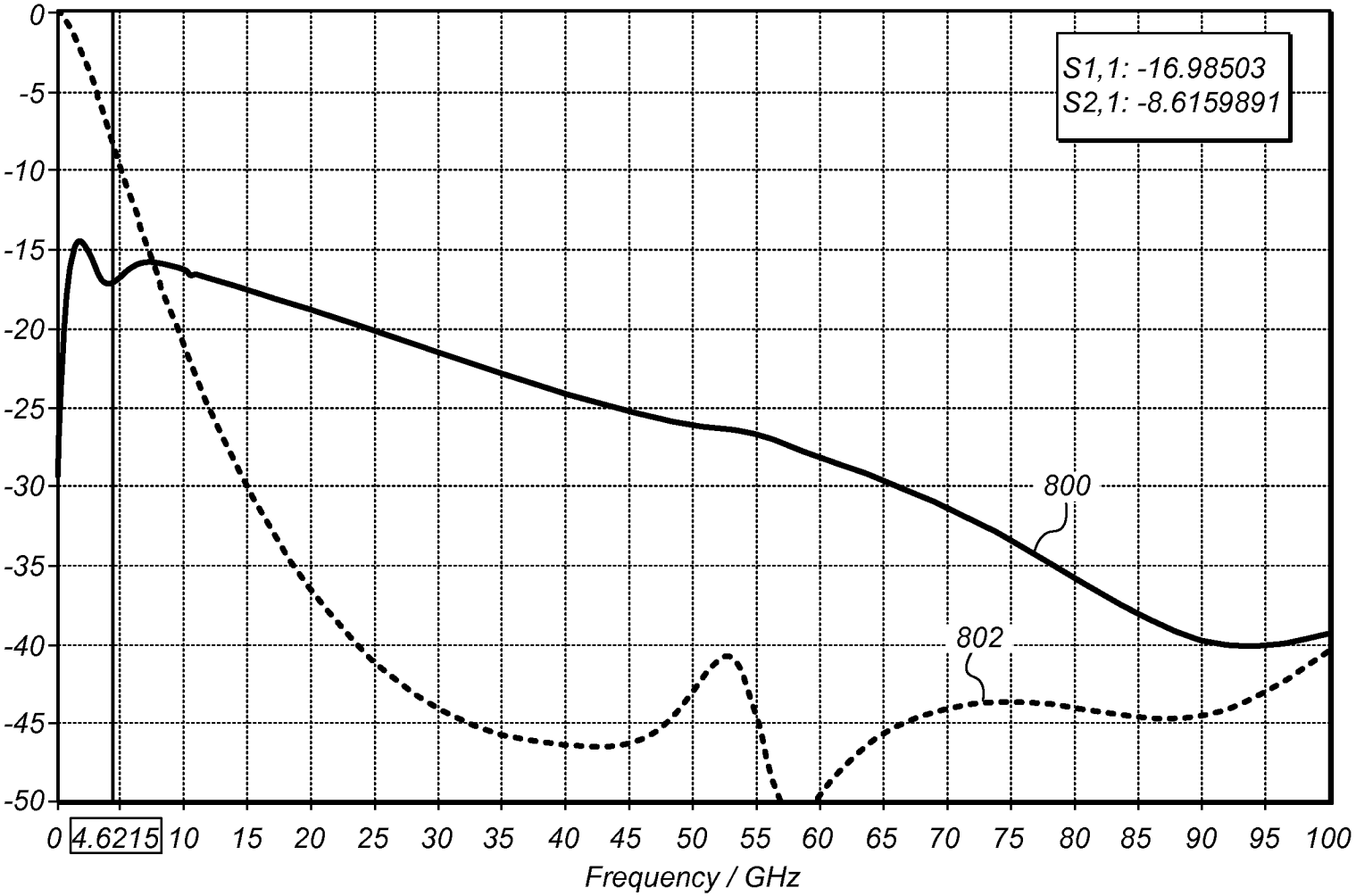
FIG. 8 is a graph of return loss and attenuation for an integrated lossy low-pass filter according to an embodiment of the present invention.

FIG. 8 is a graph of estimated return loss and attenuation for an integrated lossy low-pass filter according to an embodiment of the present invention. A return loss curve 800 (S1,1) and an attenuation curve 802 (S2,1) demonstrate the simulated performance of an embodiment of an integrated lossy low-pass filter with a thickness of 10 mil and a length of 250 mil. FIG. 8 provides an analysis for frequency values from 0-100 GHz at 5 GHz/div. The y-axis indicates attenuation and return loss values over the range −50 dB to 0 dB at 5 dB/div. Return loss curve 800 (S1,1) starts at 15 dB and improves steadily to 40 dB with increasing frequency.

Figure 9:
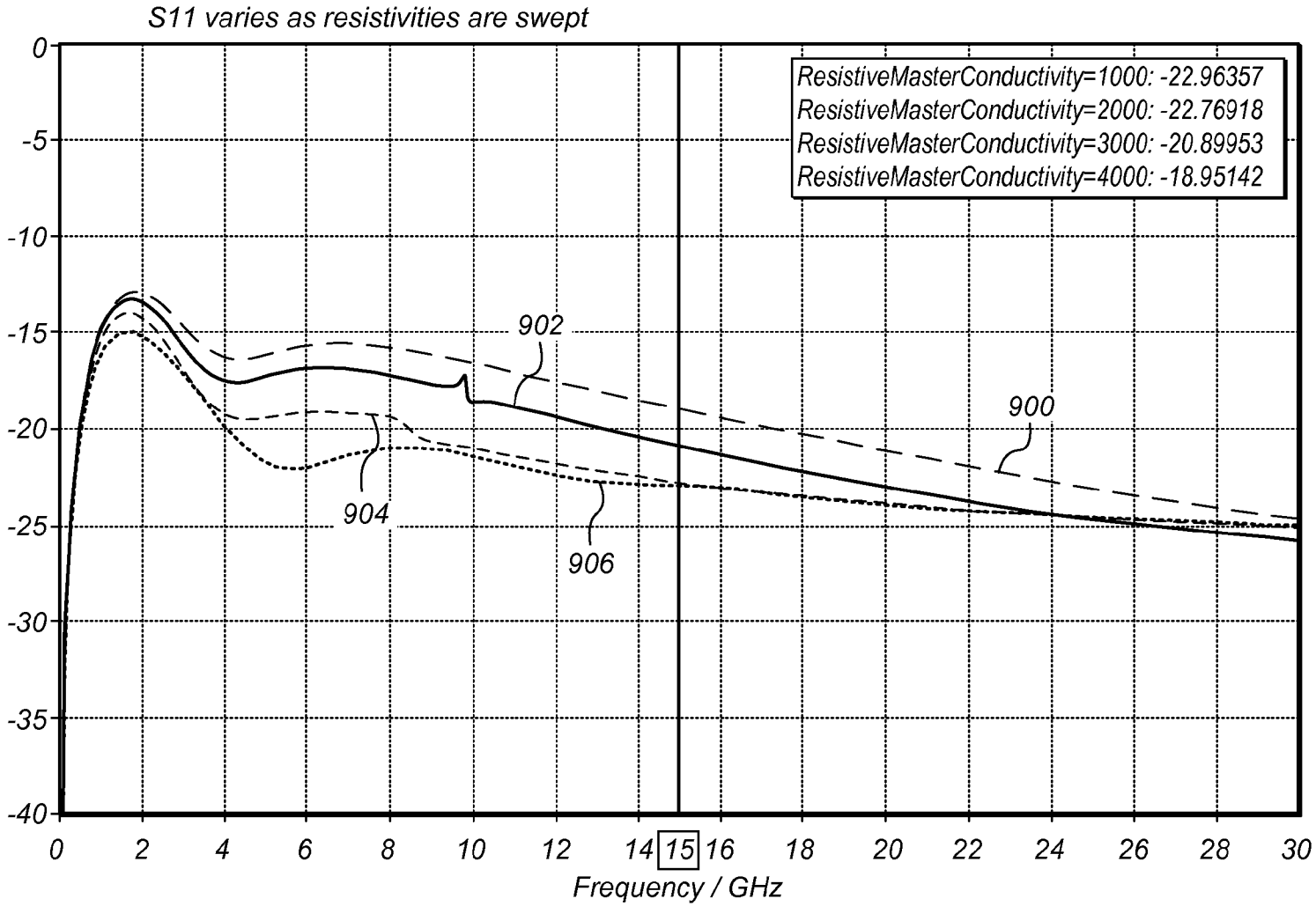
FIG. 9 is a graph of return loss for varying resistivities that can be used in integrated lossy low-pass filters according to an embodiment of the present invention.

FIG. 9 is a graph of estimated return loss for varying resistivities that can be used in integrated lossy low-pass filters according to an embodiment of the present invention. Each of return loss curves 900-906 represents a different pairing of resistivities in an integrated lossy low-pass filter of fixed geometry. For example, loss curve 906 represents a case in which a (referring briefly to FIGS. 4-6) first resistive film 410 and second resistive film 412 are fabricated from material with a resistivity of 50 ohms/square and third resistive film 424 and fourth resistive film 426 are fabricated from a material having a resistivity of 100 ohms/square.

Figure 10:
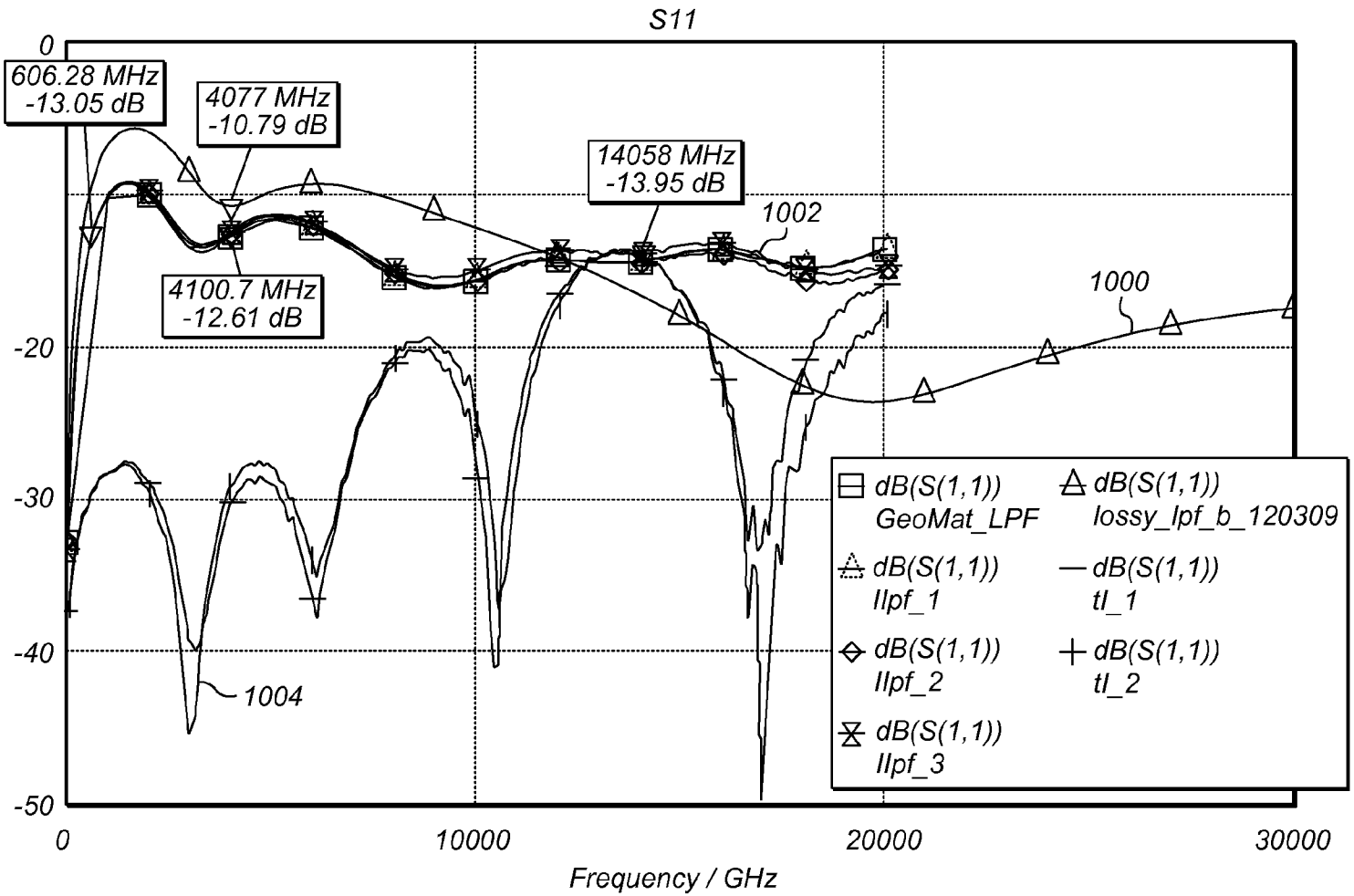
FIG. 10 is a graph of estimated and measured return loss through 20 GHz for a set of three integrated lossy low-pass filters according to an embodiment of the present invention.

FIG. 10 is a graph of estimated and measured return loss for a set of three integrated lossy low-pass filters according to an embodiment of the present invention. An estimated normalized plot of return loss 1000 is shown (through 30 GHz). A group of 3 measured return loss results for three low-pass filters 1002 (through 20 GHz) are plotted, as is return loss for two through line conductive traces 1004 in the same testing environment in which the of 3 measured return loss results for three low-pass filters 1002 were measured.

Figure 11:
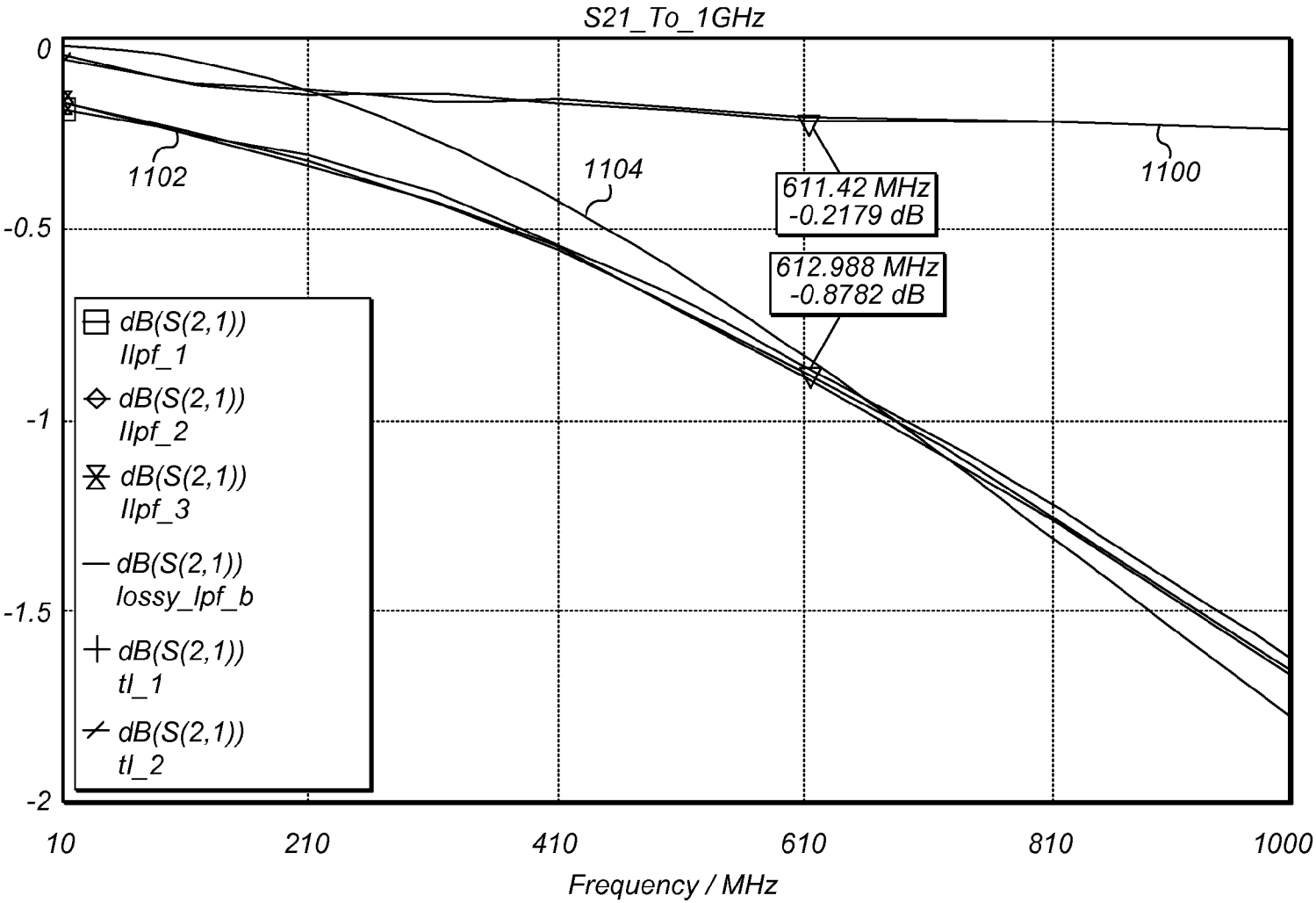
FIG. 11 is a graph of estimated and measured results with respect to attenuation in the frequency range up to 1 GHz for a set of three integrated lossy low-pass filters according to an embodiment of the present invention.

FIG. 11 is a graph of estimated and measured results with respect to attenuation in the frequency range up to 1 GHz for a set of three integrated lossy low-pass filters according to an embodiment of the present invention. An estimated plot of attenuation 1104 is shown. A group of 3 measured attenuation results for three low-pass filters 1102 are plotted, as is attenuation for two through line conductive traces 1100 in the same testing environment in which the of 3 measured attenuation results for three low-pass filters 1102 were measured.

Figure 12:
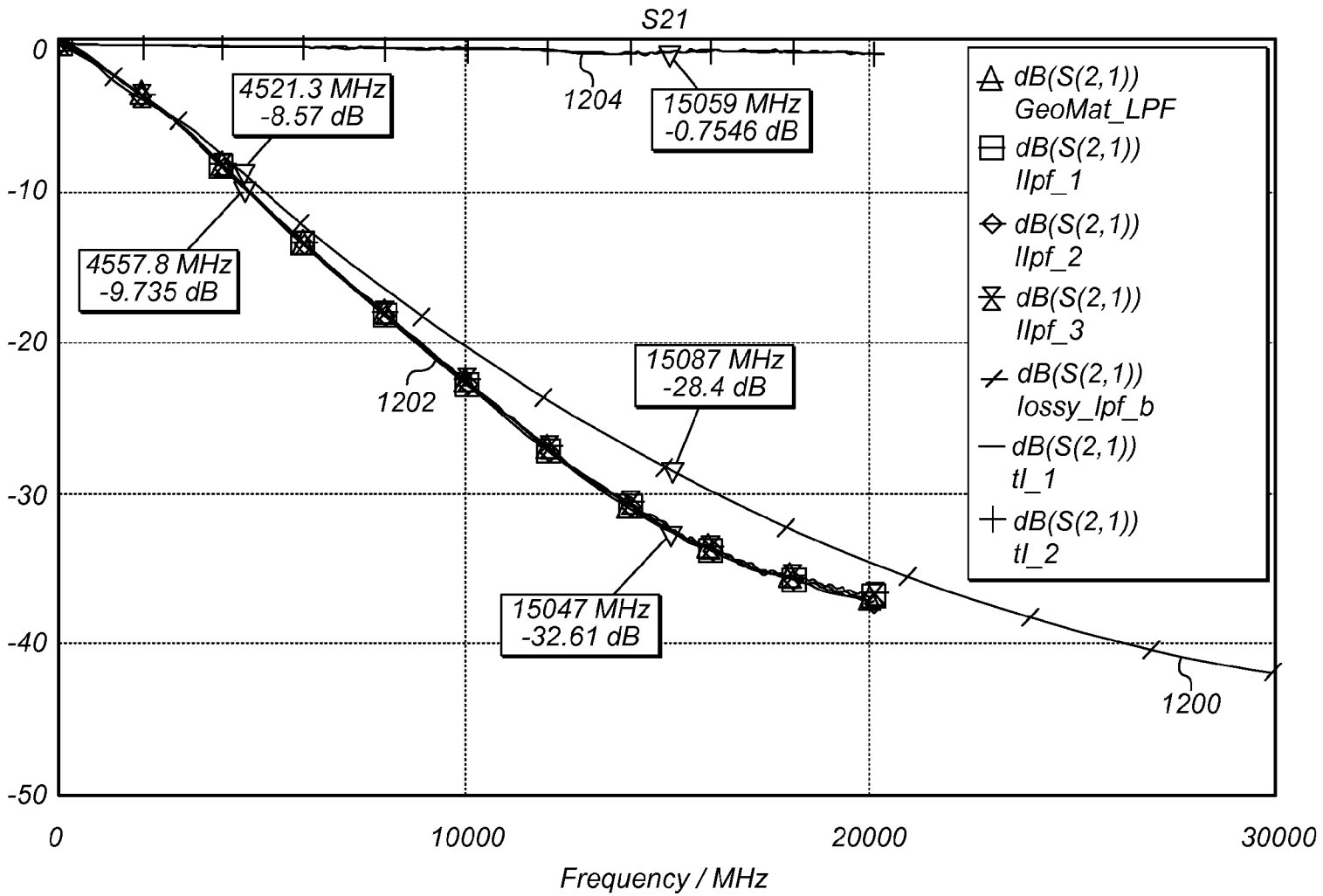
FIG. 12 is a graph of estimated and measured results with respect to attenuation in the frequency range up to 30 GHz for a set of three integrated lossy low-pass filters according to an embodiment of the present invention.

FIG. 12 is a graph of estimated and measured results with respect to attenuation in the frequency range up to 30 GHz for a set of three integrated lossy low-pass filters according to an embodiment of the present invention. An estimated plot of attenuation 1200 is shown. A group of 3 measured attenuation results for three low-pass filters 1202 are plotted, as is attenuation for two through line conductive traces 1204 in the same simulation environment in which the of 3 measured attenuation results for three low-pass filters 1202 were measured.

Figure 13:
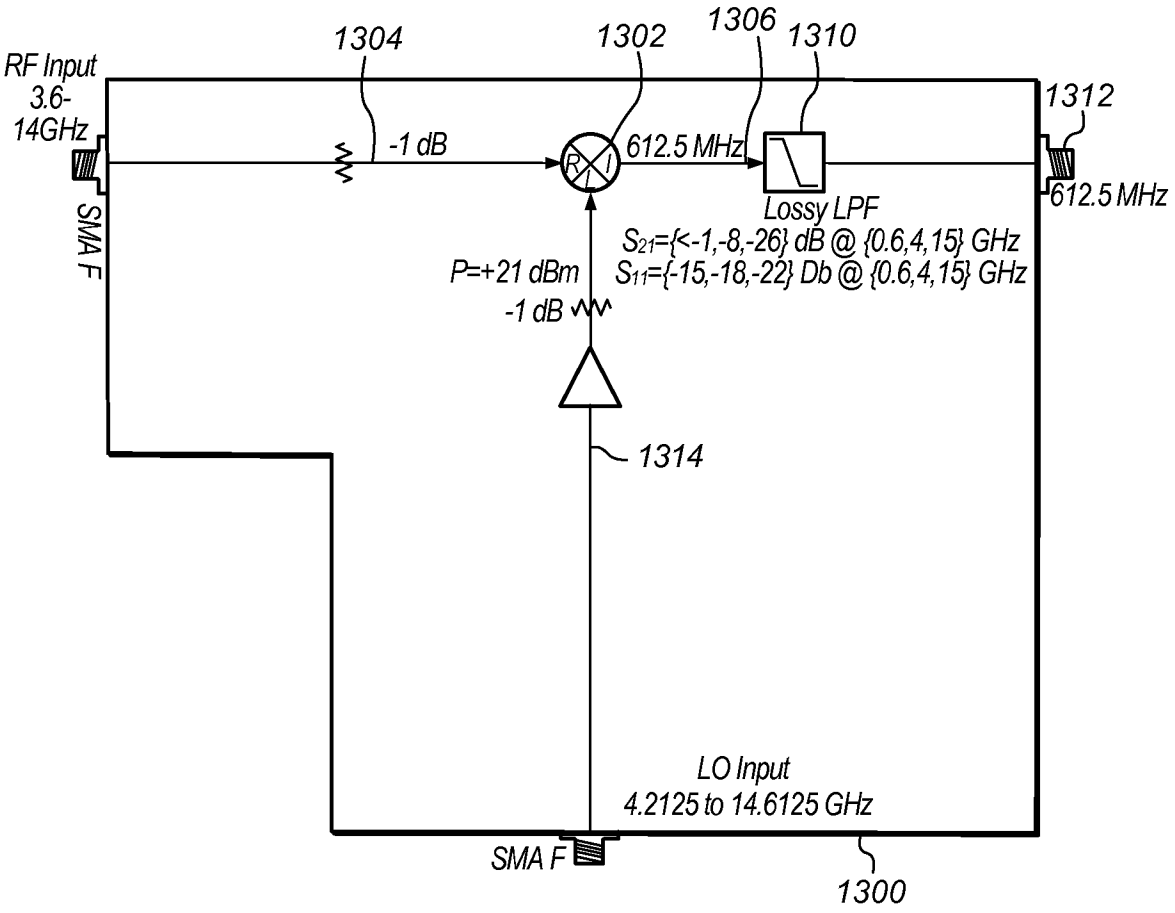
FIG. 13 is a schematic diagram of a data acquisition device that includes an integrated lossy low-pass filter according to an embodiment of the present invention.

FIG. 13 is a schematic diagram of a data acquisition device that includes an integrated lossy low-pass filter according to an embodiment of the present invention. Within a data acquisition device 1300, a mixer 1302 receives a local oscillator signal 1314 and a radio frequency signal 1304 to produce an intermediate frequency signal 1306. Intermediate frequency signal 1306 is filtered through an integrated lossy low-pass filter 1310 to produce an output signal 1312.

Figure 14:
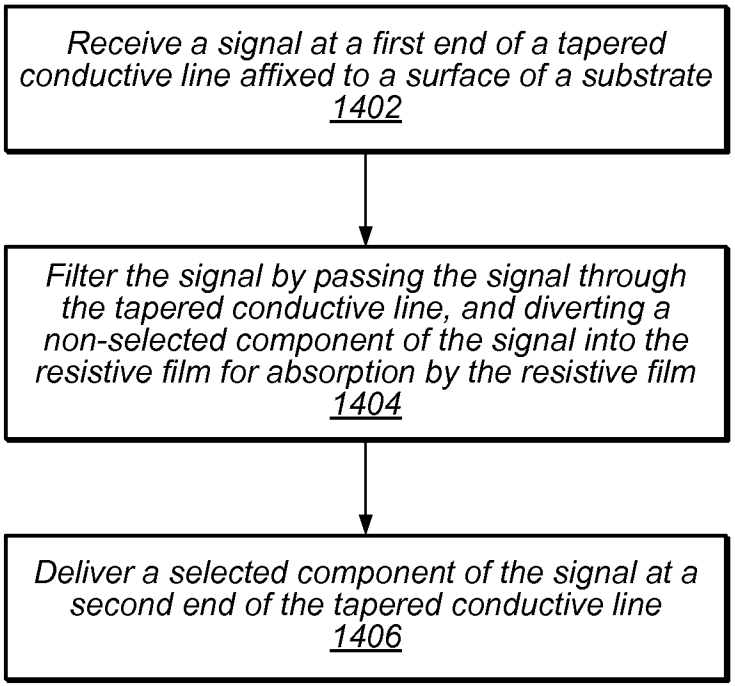
FIG. 14 depicts a high level logical flowchart of operations performed in filtering a signal using an integrated lossy low-pass filter according to one embodiment of the present invention.

FIG. 14 depicts a high level logical flowchart of operations performed in filtering a signal using an integrated lossy low-pass filter according to one embodiment of the present invention. A signal at a first end of a tapered conductive line affixed to a surface of a substrate (1402). The signal is filtered by passing the signal through the tapered conductive line (1404). Passing the signal through the tapered conductive line diverts a non-selected component of the signal into the resistive film for absorption by the resistive film. Passing the signal through the tapered conductive line further passes a selected component of the signal to a second end of the tapered conductive line. A selected component of the signal at a second end of the tapered conductive line (1406).

Although the embodiments above have been described in considerable detail, numerous variations and modifications will become apparent to those skilled in the art once the above disclosure is fully appreciated. It is intended that the following claims be interpreted to embrace all such variations and modifications.

I claim:

1. An apparatus for filtering a signal, the apparatus comprising:

a substrate;

a conductive line affixed to a surface of the substrate;

first and second resistive films affixed to the surface of the substrate, wherein each of the first and second resistive films is adjacent to a respective side of the conductive line along a first side of each of the first and second resistive films, respectively, wherein the first and second resistive films exhibit a first resistivity; and third and fourth resistive films affixed to the surface of the substrate, wherein each of the third and fourth resistive films is adjacent to a respective one of the first and second resistive films along a second side of each of the first and second resistive films, wherein each second side of the first and second resistive films extends beyond the third and fourth resistive films along a long axis of the conductive line, wherein the third and fourth resistive films exhibit a second resistivity;

wherein the conductive line is a tapered conductive line and a sum of respective widths of the tapered conductive line and the first and second resistive films is constant;

wherein, for a signal received at an end of the conductive line, the apparatus is configured to filter at least a portion of the frequency components of the signal.

2. The apparatus of claim 1, wherein a first boundary curve between the first resistive film and the conductive line is a piecewise polynomial curve.

3. The apparatus of claim 1, wherein each of the first and second resistive films entirely bounds the respective side of the conductive line along the first side of each of the first and second resistive films, respectively.

4. The apparatus of claim 1, wherein a respective thickness of each of the conductive line and each of the first, second, third and fourth resistive films is identical.

5. The apparatus of claim 1, wherein a first boundary curve between the first resistive film and the conductive line is a mirror image of a second boundary curve between the second resistive film and the conductive line.

6. The apparatus of claim 1, wherein the first resistivity is equal to ½ of the second resistivity.

7. The apparatus of claim 1, wherein the conductive line is configured to divert a high-frequency component of a signal transiting the conductive line into the first resistive film and the second resistive film.

8. The apparatus of claim 7, wherein the high-frequency component is absorbed into the first resistive film and the second resistive film.

9. The apparatus of claim 8, wherein the high-frequency component comprises a local oscillator signal.

10. The apparatus of claim 9, wherein the high-frequency component further comprises a third harmonic of the local oscillator signal.

11. The apparatus of claim 1, wherein an absorptive stop band is achieved with respect to a component of a signal transiting the conductive line without the use of discrete capacitors, inductors, or resistors.

12. The apparatus of claim 1, wherein a first boundary curve between the first resistive film and the conductive line is a piecewise linear curve.

13. A method, the method comprising:

receiving a signal at a first end of a conductive line;

filtering the signal by passing the signal through the conductive line, wherein the passing the signal through the conductive line further comprises diverting a non-selected component of the signal into a set of resistive films of different resistivities for absorption by the set of resistive films, wherein the passing the signal through the conductive line further comprises passing a selected component of the signal to a second end of the conductive line;

wherein said diverting the non-selected component of the signal into the set of resistive films further comprises diverting the non-selected component of the signal into:

first and second resistive films having a first resistivity adjacent to an entire respective side of the conductive line along a first side of each of the first and second resistive films, respectively; and third and fourth resistive films having a second resistivity adjacent to a respective one of the first and second resistive films along a portion of a respective second side of each of the first and second resistive films; and wherein said diverting the non-selected component of the signal into the set of resistive films further comprises diverting the non-selected component of the signal across a first boundary curve between the first resistive film and the conductive line that is not a mirror image of a second boundary curve between the second resistive film and the conductive line; and delivering a selected component of the signal at a second end of the conductive line.

14. The method of claim 13, wherein the first and second resistive films are configured such that a sum of respective widths of the conductive line and the first and second resistive regions varies along the length of the conductive line.

15. The method of claim 13, wherein the first boundary curve curve between the first resistive film and the conductive line is piecewise analytic.

16. The method of claim 13, wherein the diverting the non-selected component of the signal into the set of resistive films further comprises diverting the non-selected component of the signal across a first boundary curve between the first resistive film and the conductive line that is piecewise exponential.

17. The method of claim 13, wherein the diverting the non-selected component of the signal into the set of resistive films for absorption by the set of resistive films further comprises diverting a high-frequency component of the signal into the set of resistive films for absorption by the set of resistive films.

18. An apparatus for filtering a signal, the apparatus comprising:

a substrate;

a conductive line affixed to a surface of the substrate;

first and second resistive films affixed to the surface of the substrate, wherein each of the first and second resistive films is adjacent to a respective side of the conductive line along a first side of each of the first and second resistive films, respectively, wherein the first and second resistive films exhibit a first resistivity; and third and fourth resistive films affixed to the surface of the substrate, wherein each of the third and fourth resistive films is adjacent to a respective one of the first and second resistive films along a second side of each of the first and second resistive films, wherein each second side of the first and second resistive films extends beyond the third and fourth resistive films along a long axis of the conductive line, wherein the third and fourth resistive films exhibit a second resistivity;

wherein a first boundary curve between the first resistive film and the conductive line is a mirror image of a second boundary curve between the second resistive film and the conductive line;

wherein, for a signal received at an end of the conductive line, the apparatus is configured to filter at least a portion of the frequency components of the signal.

19. The apparatus of claim 18, wherein the conductive line is configured to divert a high-frequency component of a signal transiting the conductive line into the first resistive film and the second resistive film.

20. The apparatus of claim 18, wherein an absorptive stop band is achieved with respect to a component of a signal transiting the conductive line without the use of discrete capacitors, inductors, or resistors.

21. An apparatus for filtering a signal, the apparatus comprising:

a substrate;

a conductive line affixed to a surface of the substrate;

first and second resistive films affixed to the surface of the substrate, wherein each of the first and second resistive films is adjacent to a respective side of the conductive line along a first side of each of the first and second resistive films, respectively, wherein the first and second resistive films exhibit a first resistivity; and third and fourth resistive films affixed to the surface of the substrate, wherein each of the third and fourth resistive films is adjacent to a respective one of the first and second resistive films along a second side of each of the first and second resistive films, wherein each second side of the first and second resistive films extends beyond the third and fourth resistive films along a long axis of the conductive line, wherein the third and fourth resistive films exhibit a second resistivity;

wherein a first boundary curve between the first resistive film and the conductive line is a piecewise linear curve; and wherein, for a signal received at an end of the conductive line, the apparatus is configured to filter at least a portion of the frequency components of the signal.

22. The apparatus of claim 21, wherein the conductive line is configured to divert a high-frequency component of a signal transiting the conductive line into the first resistive film and the second resistive film.

23. The apparatus of claim 21, wherein an absorptive stop band is achieved with respect to a component of a signal transiting the conductive line without the use of discrete capacitors, inductors, or resistors.

24. An apparatus for filtering a signal, the apparatus comprising:

a substrate;

a conductive line affixed to a surface of the substrate;

first and second resistive films affixed to the surface of the substrate, wherein each of the first and second resistive films is adjacent to a respective side of the conductive line along a first side of each of the first and second resistive films, respectively, wherein the first and second resistive films exhibit a first resistivity; and third and fourth resistive films affixed to the surface of the substrate, wherein each of the third and fourth resistive films is adjacent to a respective one of the first and second resistive films along a second side of each of the first and second resistive films, wherein each second side of the first and second resistive films extends beyond the third and fourth resistive films along a long axis of the conductive line, wherein the third and fourth resistive films exhibit a second resistivity;

wherein a first boundary curve between the first resistive film and the conductive line is a piecewise polynomial curve; and wherein, for a signal received at an end of the conductive line, the apparatus is configured to filter at least a portion of the frequency components of the signal.

25. The apparatus of claim 24, wherein the conductive line is configured to divert a high-frequency component of a signal transiting the conductive line into the first resistive film and the second resistive film.

26. The apparatus of claim 24, wherein an absorptive stop band is achieved with respect to a component of a signal transiting the conductive line without the use of discrete capacitors, inductors, or resistors.

27. A method, the method comprising:

receiving a signal at a first end of a conductive line;

filtering the signal by passing the signal through the conductive line, wherein the passing the signal through the conductive line further comprises diverting a non-selected component of the signal into a set of resistive films of different resistivities for absorption by the set of resistive films, wherein the passing the signal through the conductive line further comprises passing a selected component of the signal to a second end of the conductive line;

wherein said diverting the non-selected component of the signal into the set of resistive films further comprises diverting the non-selected component of the signal into:

first and second resistive films having a first resistivity adjacent to an entire respective side of the conductive line along a first side of each of the first and second resistive films, respectively; wherein the first and second resistive films are configured such that a sum of respective widths of the conductive line and the first and second resistive films varies along the length of the conductive line and third and fourth resistive films having a second resistivity adjacent to a respective one of the first and second resistive films along a portion of a respective second side of each of the first and second resistive films; and delivering said selected component of the signal at the second end of the conductive line.

28. The method of claim 27, wherein the diverting the non-selected component of the signal into the set of resistive films for absorption by the set of resistive films further comprises diverting a high-frequency component of the signal into the set of resistive films for absorption by the set of resistive films.

29. A method, the method comprising:

receiving a signal at a first end of a conductive line;

filtering the signal by passing the signal through the conductive line, wherein the passing the signal through the conductive line further comprises diverting a non-selected component of the signal into a set of resistive films of different resistivities for absorption by the set of resistive films, wherein the passing the signal through the conductive line further comprises passing a selected component of the signal to a second end of the conductive line;

wherein said diverting the non-selected component of the signal into the set of resistive films further comprises diverting the non-selected component of the signal into:

first and second resistive films having a first resistivity adjacent to an entire respective side of the conductive line along a first side of each of the first and second resistive films, respectively; and third and fourth resistive films having a second resistivity adjacent to a respective one of the first and second resistive films along a portion of a respective second side of each of the first and second resistive films; and wherein the diverting the non-selected component of the signal into the set of resistive films further comprises diverting the non-selected component of the signal across a first boundary curve between the first resistive film and the conductive line that is piecewise analytic; and delivering a selected component of the signal at a second end of the conductive line.

30. The method of claim 29, wherein the diverting the non-selected component of the signal into the set of resistive films for absorption by the set of resistive films further comprises diverting a high-frequency component of the signal into the set of resistive films for absorption by the set of resistive films.

31. A method, the method comprising:

receiving a signal at a first end of a conductive line;

filtering the signal by passing the signal through the conductive line, wherein the passing the signal through the conductive line further comprises diverting a non-selected component of the signal into a set of resistive films of different resistivities for absorption by the set of resistive films, wherein the passing the signal through the conductive line further comprises passing a selected component of the signal to a second end of the conductive line;

wherein said diverting the non-selected component of the signal into the set of resistive films further comprises diverting the non-selected component of the signal into:

first and second resistive films having a first resistivity adjacent to an entire respective side of the conductive line along a first side of each of the first and second resistive films, respectively; and third and fourth resistive films having a second resistivity adjacent to a respective one of the first and second resistive films along a portion of a respective second side of each of the first and second resistive films; and wherein the diverting the non-selected component of the signal into the set of resistive films further comprises diverting the non-selected component of the signal across a first boundary curve between the first resistive film and the conductive line that is piecewise exponential; and delivering a selected component of the signal at a second end of the conductive line.

32. The method of claim 31, wherein the diverting the non-selected component of the signal into the set of resistive films for absorption by the set of resistive films further comprises diverting a high-frequency component of the signal into the set of resistive films for absorption by the set of resistive films.

* * * * *

UNITED STATES PATENT AND TRADEMARK OFFICE

CERTIFICATE OF CORRECTION

PATENT NO. : 8,754,725 B2
APPLICATION NO. : 13/025692
DATED : June 17, 2014
INVENTOR(S) : Barnett It is certified that error appears in the above-identified patent and that said Letters Patent is hereby corrected as shown below:

In the Claims:

Claim 15, Column 12, Lines 1-2, please delete "boundary curve curve" and substitute -- boundary curve --;

Claim 16, Column 12, Lines 4-7, please delete "the diverting the non-selected component of the signal into the set of resistive films further comprises diverting the non-selected component of the signal across a first boundary curve" and substitute -- the first boundary curve --; and Claim 16, Column 12, Line 8, please delete "that is" and substitute -- is --.

Signed and Sealed this
Ninth Day of September, 2014

Michelle K. Lee

Michelle K. Lee
*Deputy Director of the United States Patent and Trademark Office*